US006796292B2

(12) United States Patent
Lewis et al.

(10) Patent No.: US 6,796,292 B2
(45) Date of Patent: Sep. 28, 2004

(54) ENGINE AIR AMOUNT PREDICTION BASED ON ENGINE POSITION

(75) Inventors: Donald James Lewis, Howell, MI (US); John D. Russell, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/374,189

(22) Filed: Feb. 26, 2003

(65) Prior Publication Data

US 2004/0163634 A1 Aug. 26, 2004

(51) Int. Cl.[7] ..... F02D 41/06
(52) U.S. Cl. ..... 123/487; 123/491
(58) Field of Search ..... 123/487, 491

(56) References Cited

U.S. PATENT DOCUMENTS

| | | | | |
|---|---|---|---|---|
| 4,432,325 | A | | 2/1984 | Auracher et al. |
| 4,653,452 | A | | 3/1987 | Sawada et al. |
| 4,951,499 | A | | 8/1990 | Akimoto |
| 5,159,914 | A | | 11/1992 | Follmer et al. |
| 5,215,062 | A | * | 6/1993 | Asano et al. ..... 123/491 |
| 5,311,936 | A | | 5/1994 | McNair et al. |
| 5,483,946 | A | | 1/1996 | Hamburg et al. |
| 5,497,329 | A | | 3/1996 | Tang |
| 5,537,977 | A | | 7/1996 | Hartman et al. |
| 5,654,501 | A | | 8/1997 | Grizzle et al. |
| 5,755,212 | A | | 5/1998 | Ajima |
| 5,870,986 | A | | 2/1999 | Ichinose |
| 5,893,349 | A | | 4/1999 | Rado |
| 5,983,868 | A | | 11/1999 | Ichinose |
| RE36,737 | E | | 6/2000 | Brehob et al. |
| 6,089,082 | A | | 7/2000 | Kotwicki et al. |
| 6,135,087 | A | | 10/2000 | DeGeorge et al. |
| 6,155,242 | A | | 12/2000 | Kotwicki et al. |
| 6,170,475 | B1 | | 1/2001 | Lewis et al. |
| 6,223,121 | B1 | * | 4/2001 | Ishida et al. ..... 701/113 |
| 6,282,485 | B1 | | 8/2001 | Kotwicki et al. |
| 6,360,531 | B1 | | 3/2002 | Wiemero et al. |

OTHER PUBLICATIONS

C.F. Aquino, "Transient A/F Control Characteristics of the 5 Liter Central Fuel Injection Engine", SAE 810494, Feb. 23–27, 1981.

* cited by examiner

*Primary Examiner*—Amdrew M. Dolinar
(74) *Attorney, Agent, or Firm*—Allan J. Lippa

(57) ABSTRACT

A system and method to predict engine air amount for an internal combustion engine is described. Included is a method to predict a change in engine air amount based on engine position. This method especially suited to engine starts, where engine air amount is difficult to predict due to low engine speed and limited sensor information. The system and method provides the prediction of engine air amount without extensive models or calibration. Fuel is supplied based on the predicted engine air amount.

9 Claims, 8 Drawing Sheets

| Inj even | Air Method | Delta Predicted Engine Air Amount | y(k+1) | Ao*y(k) | y(k) | B1*x(k+1) | x(k+1) | Bo*x(k) | x(k) |
|---|---|---|---|---|---|---|---|---|---|
| 1 | IGL | 0 | -6.85E-06 | 0 | 0 | -6.8513E-06 | 8.59E+01 | 0 | 0 |
| 2 | IGL | 0 | -4.81E-06 | 4.66E-06 | -6.85E-06 | -2.20135E-06 | 2.76E+01 | 2.06426E-06 | 8.59E+01 |
| 3 | IGL | 0 | -3.29E-06 | 3.27E-06 | -4.81E-06 | -6.81142E-07 | 8.54 | 6.63256E-07 | 2.76E+01 |
| 4 | PP | -2.83E-05 | -2.20E-06 | 2.24E-06 | -3.29E-06 | -1.69887E-07 | 2.13 | 2.05225E-07 | 8.54 |
| 5 | PP | -3.42E-05 | -1.51E-06 | 1.50E-06 | -2.20E-06 | -6.25311E-08 | 7.84E-01 | 5.1186E-08 | 2.13E+00 |
| 6 | PP | -3.15E-05 | -1.16E-05 | 1.03E-06 | -1.51E-06 | -1.06E-05 | 1.33E+02 | 1.88403E-08 | 7.84E-01 |
| 7 | DN | -2.57E-05 | -2.57E-05 | 7.90E-06 | -1.16E-05 | -2.10085E-05 | 2.63E+02 | 3.19612E-06 | 1.33E+02 |
| 8 | DN | -2.31E-05 | -2.31E-05 | 1.75E-05 | -2.57E-05 | -1.20117E-05 | 1.51E+02 | 6.32977E-06 | 2.63E+02 |
| 9 | DN | -2.36E-05 | -2.36E-05 | 1.57E-05 | -2.31E-05 | -1.14853E-05 | 1.44E+02 | 3.61907E-06 | 1.51E+02 |
| 10 | DN | -2.06E-05 | -2.06E-05 | 1.61E-05 | -2.36E-05 | -7.9759E-06 | 1.00E+02 | 3.46046E-06 | 1.44E+02 |
| 11 | DN | -1.73E-05 | -1.73E-05 | 1.40E-05 | -2.06E-05 | -5.66289E-06 | 7.10E+01 | 2.4031E-06 | 1.00E+02 |
| 12 | DN | -1.84E-05 | -1.84E-05 | 1.18E-05 | -1.73E-05 | -8.29494E-06 | 1.04E+02 | 1.7062E-06 | 7.10E+01 |
| 13 | DN | -1.92E-05 | -1.92E-05 | 1.25E-05 | -1.84E-05 | -9.17229E-06 | 1.15E+02 | 2.49922E-06 | 1.04E+02 |
| 14 | DN | -1.76E-05 | -1.76E-05 | 1.31E-05 | -1.92E-05 | -7.33783E-06 | 9.20E+01 | 2.76357E-06 | 1.15E+02 |

Ao=-.6807
B1=-7.9759e-8
Bo=2.4031e-8
Identified engine speed/engine air amount transfer function = y(k+1)+Ao*y(k)=B1*x(k+1)+Bo*x(k)

Figure 7B

ENGINE AIR AMOUNT PREDICTION BASED ON ENGINE POSITION

FIELD OF INVENTION

The present invention relates to a method for controlling an internal combustion engine and more particularly to a method for adjusting injected fuel based on a prediction of air entering a cylinder for future induction events.

BACKGROUND OF THE INVENTION

Engine starting control has a significant impact on engine emissions. Conventional methods use several different approaches to start an engine. Some approaches use fixed fuel injection values based on empirical testing, while others read sensors and attempt to calculate fueling based on the current state of the sensor information One method to adjust fuel during an engine start is described in U.S. Pat. No. 5,870,986. This apparatus provides a start timing fuel injection controlling apparatus for an internal combustion engine. The fuel injection is performed in synchronism with an intake stroke of each cylinder in starting the internal combustion engine provided with a plurality of cylinders. The apparatus counts a total number of fuel injections in all the cylinders from a start of an operation of the engine. It advances by a predetermined period a fuel injection start timing when the count is equal to or more than a predetermined number.

The inventors herein have recognized several disadvantages of this approach. Namely, the approach focuses simply on changing when the fuel injection is performed, but does not recognize that air quantity changes for each cylinder during a start depending on injection count. Therefore, the above-mentioned approach does not fuel the engine as accurately as possible since the air that actually enters the cylinders changes throughout the engine start and depends on when the fuel injection is first started, as well as various other parameters. In addition, the above-mentioned approach does not predict future engine events, which also reduces fueling accuracy. Yet another disadvantage of the before-mentioned approach is that it does not have the ability to adapt to engine wear or manufacturing variation.

SUMMARY OF THE INVENTION

In accordance with the present invention a method that accurately predicts an engine air amount during start is presented. The method comprises: counting a number of cylinders receiving at least one fuel injection from a start of an operation of the internal combustion engine; and calculating an estimated engine air quantity based on said counted number of cylinders, and adjusting delivered fuel based on said estimated engine air quantity. This method can be used to reduce the above-mentioned limitations of the prior art approaches.

By estimating an engine air quantity based on a number of cylinders receiving at least one fuel injection, it is possible to accurately determine the amount of air in the engine and thereby provide an appropriate quantity of fuel, even as the air is changing during a start.

In other words, from the first cylinder to receive fuel and the number of cylinder firings per revolution it is possible to predict when the first fueled cylinder and subsequent cylinders will fire. During a start, the fired cylinders produce a large engine acceleration. The acceleration in turn increases the piston speed of other cylinders in the engine. For cylinders on their intake stroke, inducting air, the acceleration increases the rate of pressure drop in the cylinder. This causes increased flow from the intake manifold into the cylinder during induction, resulting in evacuation of the intake manifold and a corresponding change in engine air amount. Therefore, by keeping track of the number of fuel injections, the corresponding change in engine air amount can be predicted. Also, given similar starting conditions such as barometric pressure, air temperature, and engine temperature, an engine will fire and induct air in a consistent manner. Consequently, engine air quantity measurements from past starts can be used to accurately predict future engine air amounts, and therefore factors such as engine wear can be taken into account.

It is possible to derive engine position and expected cylinder firing using many alternatives. Counting individual injections is one method, but some starting strategies use multiple injections per cylinder to start an engine. Therefore, the number of injections exceed the number of cylinder events, however it is still a simple matter to determine when the engine will fire because engine position can still be determined. For this reason, it is not important what engine position related parameter is counted, but it is important to count an engine parameter that allows the engine controller to determine engine position during a start.

The present invention provides the advantage of improved air/fuel control during engine starting, resulting in lower emissions. This advantage is especially advantageous when a catalyst is cold and its efficiency is low.

Note that there are various approach to identifying engine starting. For example, the engine start can be the period between when an engine begins turning under the power of a starter, until it is rotating at or above a desired idle speed. Alternative, the engine start can refer to engine cranking and run-up. Still another approach A to identifying engine starting is the period beginning from key-on until a desired engine speed/load is reached.

The above advantages and other advantages, objects and features of the present invention will be readily apparent from the following detailed description of the preferred embodiments when taken in connection with the accompanying drawings.

BRIEF DESCRIPTION OF THE DRAWINGS

The objects and advantages described herein will be more fully understood by reading an example of an embodiment in which the invention is used to advantage, referred to herein as the Description of Preferred Embodiment, with reference to the drawings, wherein:

FIG. 7*b* is a table of example air amount changes during a start;

DESCRIPTION OF INVENTION

Figure 1:
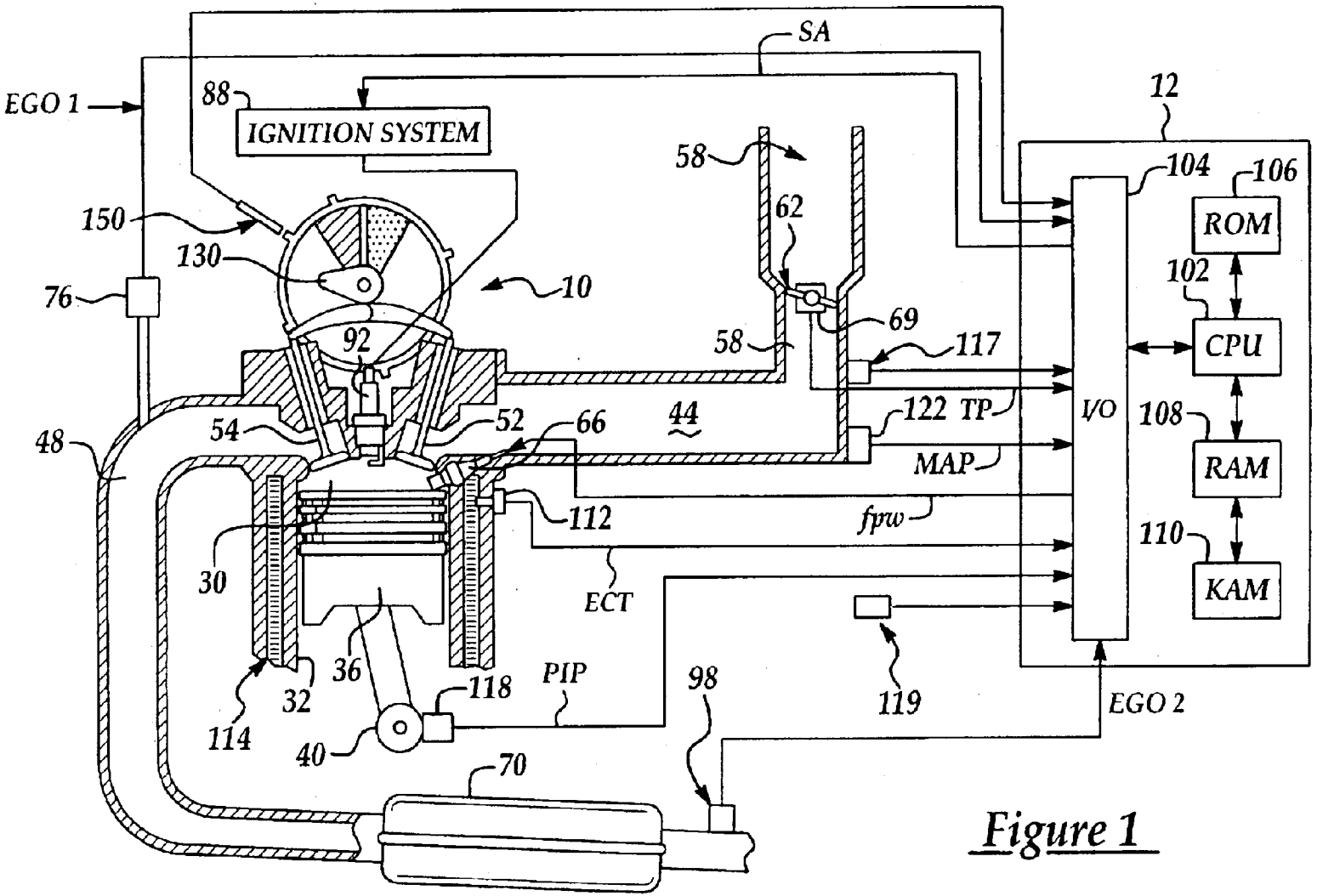
FIG. 1 is a schematic diagram of an engine wherein the invention is used to advantage.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with camshaft 130 and piston 36 positioned therein and connected to crankshaft 40. Combustion chamber 30 is known communicating with intake manifold 44 and exhaust manifold 48 via respective intake valve 52 an exhaust valve 54. Combustion chamber 30 is also shown having fuel injector 66 coupled thereto for delivering liquid fuel in proportion to the pulse width of signal FPW from controller 12. Fuel is delivered to fuel injector 66 by fuel system (not shown) including a fuel tank, fuel pump, and fuel rail (not shown). Alternatively, the engine may be configured such that the fuel is injected directly into the intake manifold, directed at the cylinder port, which is known to those skilled in the art as port fuel injection. Intake manifold 44 is shown communicating with throttle body 58 via throttle plate 62.

Conventional distributorless ignition system 88 provides ignition spark to combustion chamber 30 via spark plug 92 in response to controller 12. Two-state exhaust gas oxygen sensor 76 is shown coupled to exhaust manifold 48 upstream of catalytic converter 70. Two-state exhaust gas oxygen sensor 98 is shown coupled to exhaust manifold 48 downstream of catalytic converter 70. Sensor 76 provides signal EGO1 to controller 12.

Controller 12 is shown in FIG. 1 as a conventional microcomputer including: microprocessor unit 102, input/output ports 104, and read-only memory 106, random access memory 108, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a measurement of manifold absolute pressure (MAP) form pressure sensor 122 coupled to intake manifold 44; a measurement (ACT) of engine air amount temperature or manifold temperature from temperature sensor 117; a cam position signal (CAM) from cam sensor 150; a profile ignition pickup signal (PIP) from a Hall effect sensor 118 coupled to a crankshaft 40, and an engine speed signal (RPM) from engine speed sensor 119. In a preferred aspect of the present invention, engine speed sensor 119 produces a predetermined number of equally spaced pulses every revolution of the crankshaft.

Figure 2:
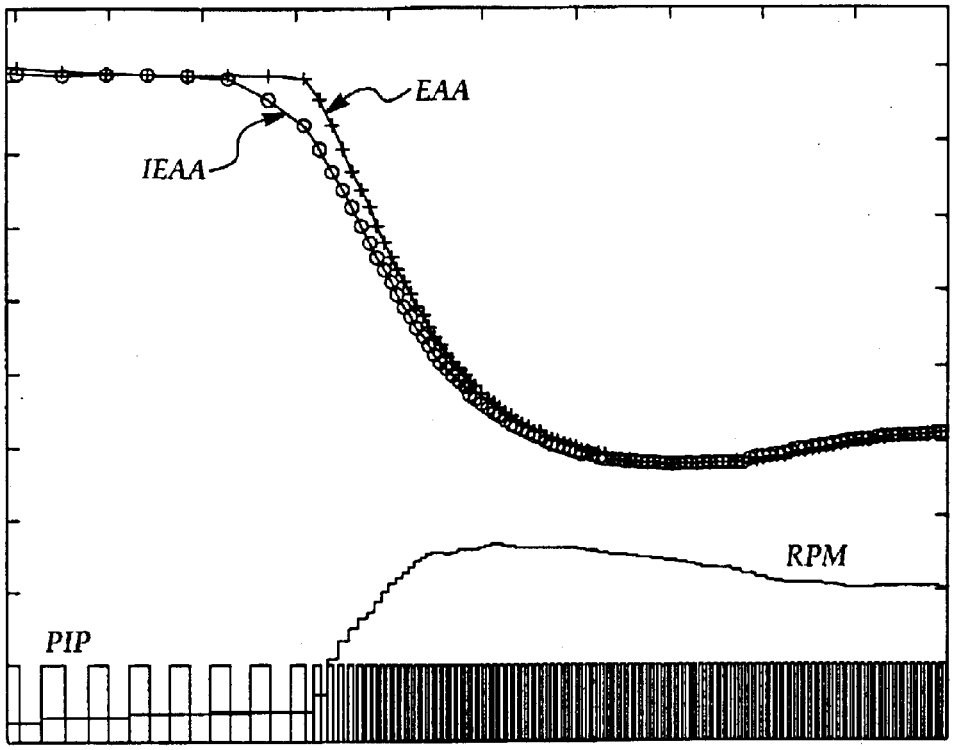
FIG. 2 is a plot showing engine air amount and the ideal engine air amount during a start.

Referring to FIG. 2, a plot showing several signal trajectories as they occur when starting a six-cylinder engine is shown. The signals in FIGS. 2–5 have been scaled to show the relationships between the signals and not their actual magnitudes. The signal labeled PIP, uses a rising edge to identify each engine cylinder position 10 degrees prior to top-dead-center of compression stroke, creating an engine event signal. The period of the cylinder event in degrees is: 720/number of engine cylinders. In other words, an engine event is a cylinder reaching top-dead-center of compression stroke; PIP is constructed relative to engine events and all cylinders will fire over a period of 720 degrees.

Engine sensors are sampled relative to the PIP signal. Sampling may occur on rising or falling edge or in any combination of edges. The +'s and O's represent data captured at the falling edge of PIP. It is also recognized that engine position could be derived from a signal with more or less resolution than the one shown here. The signal labeled "EAA", Engine Air Amount, identified by +'s, is the air mass entering a given cylinder when the sample was taken at the PIP edge. The signal labeled "IEAA", two-event ideal prediction of engine air amount, identified by O's, is the two-event ideal prediction of air mass entering a given cylinder. Air mass data gathered during a start is shifted two PIP events to create this signal. As will be described below, this ideal prediction is not available in real-time, and thus the present invention describes various ways to estimate these values.

The area between the engine air amount signal (EAA) and two-event ideal engine air amount (IEAA) signal is the region that conventional approaches can produce and this is the error the present invention seeks to reduce. Notice, as the engine speed increases the engine air amount decreases. This is an important observation linking a change in engine speed to a change in engine air amount utilized in the present invention as described below. In other words, the present invention recognizes that a prediction of an engine air amount for future induction events can be predicted based on measured change in engine speed.

Figure 3A:
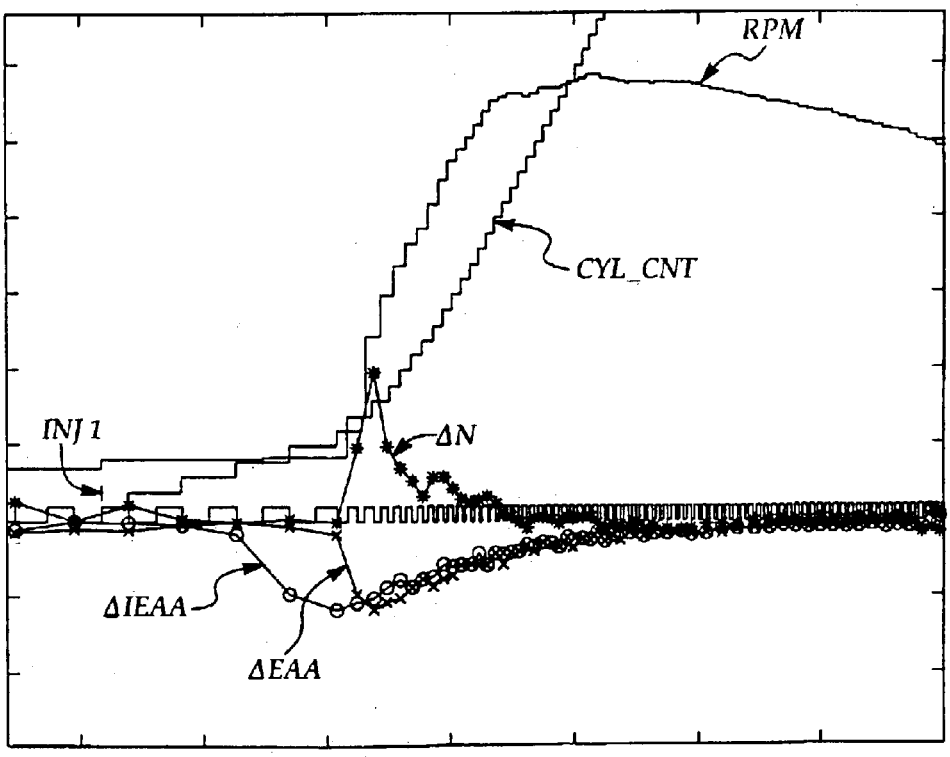
FIG. 3A is a plot showing how a change in engine speed is related to the change in ideal air amount during a start, signals are referenced to first injection.

Referring to FIG. 3A, a plot shows important signals used to create two-event predicted engine air amount based on a change in engine speed, referenced to an injection counter (CYL_CNT). PIP is shown again because it illustrated the relative timing between signals of interest. Signals identifying the location of first injection and the number of events after first injection are also, shown, INJ1 and CYL_CNT. Difference in engine speed (ΔN), identified by *'s, change in ideal engine air amount (ΔIEAA), identified by O's, change in engine air amount (ΔEAA), identified by +'s, and engine speed (RPM) are also shown.

The figure shows that a change in engine speed and change in engine air amount gives little indication of changing predicted ideal engine air amount two events prior to the first indication of engine acceleration. However, once engine position and the first cylinder to receive fuel are known, change in engine speed and change in engine air amount can be more accurately predicted.

After engine position is determined, counting the number of engine events after first injection allows the engine controller to predict where the first cylinder fueled will fire. This is possible because the fueled cylinder will almost always fire, when properly fueled, the same number of events after receiving fuel. The firing of a cylinder increases engine speed resulting in a change of engine air amount. Therefore, by predicting when the first cylinder will fire, controller 12 is able predict the change in engine air amount prior to the cylinder firing.

An injection counter is formed by incrementing the variable CYL_CNT each time an injection occurs, starting from the first injection. Since the fuel is delivered sequentially, each engine event has a corresponding injection. Therefore, once the injection counter starts it will increment on every engine event.

According to the present invention, controller 12 provides the prediction of change in engine air amount based on engine position until a minimum number of injections have occurred or a predetermined level of engine acceleration has been exceeded (CYL_CNT>OL_PRE). Where CYL_CNT is the number of injections and OL_PRE is the number of predetermined engine position based predictions. Thereafter, a change in engine speed is used to predict a change in engine air amount during a start. After the engine has started a different two-event engine air amount prediction method is used as described below with regard to FIG. 6.

Figure 3B:
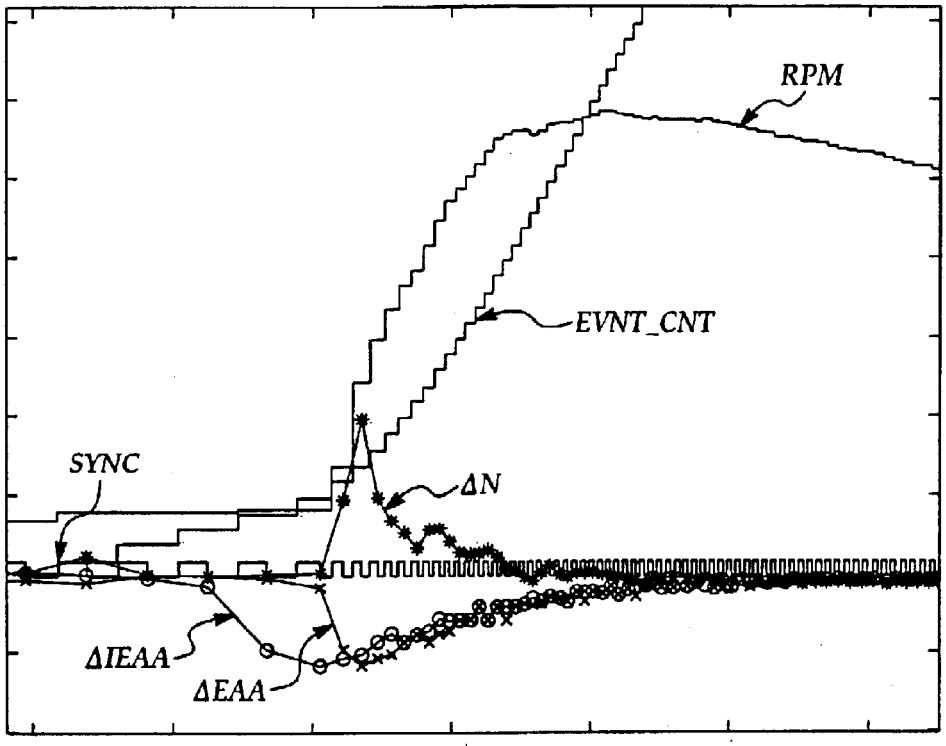
FIG. 3B is a plot showing how a change in engine speed is related to the change in ideal air amount during a start, signals are referenced to first known engine position.

Referring to FIG. 3B, a plot similar to FIG. 3A is shown, but it also shows signals that identify the location where engine position is first known and the numbers of events thereafter, SYNC and EVNT_CNT. These two signals are used to show an alternate embodiment to the method described by FIG. 3A, two-event predicted engine air amount referenced to an engine event counter. Difference in engine speed (ΔN), identified by *'s, change in ideal engine air amount (ΔIEAA), identified by O's, change in engine air amount (ΔEAA), identified by +'s, and engine speed (RPM) are also shown.

Counting the number of engine events after engine position is known allows engine controller 12 to predict where the first cylinder fueled will fire. This is possible because the first fueled cylinder will almost always fire, when properly fueled, the same number of events after receiving fuel. Knowing the number of events after first injection where firing will occur, along with the number of events between engine position identification and first fueling, the total number of events between position identification and first firing can be established. Using the same procedure described in FIG. 3A, but counting from where engine position is first known, controller 12 is able predict the change in engine air amount prior to the cylinder firing.

Figure 4:
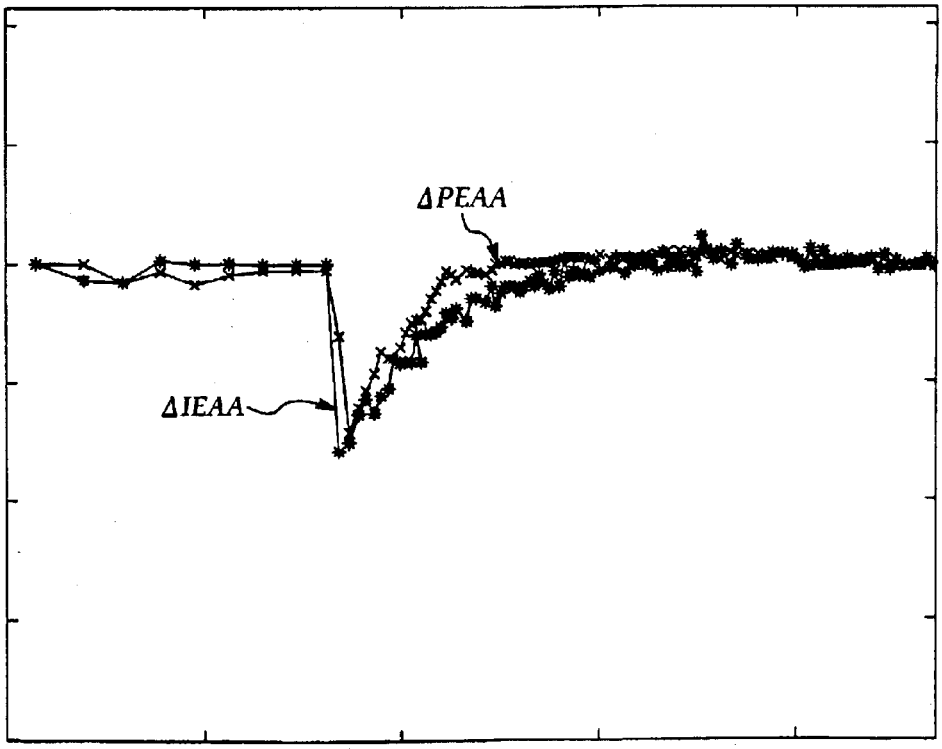
FIG. 4 is a plot showing a comparison between prediction of a change in engine air amount based on engine speed and ideal engine air amount at start.

Referring to FIG. 4, a plot showing shows change in two-event ideal engine air amount (ΔIEAA), identified by *'s, and change in predicted two-event engine air amount (ΔPEAA), identified by x's. Taking the difference between EAA and IEAA, then zeroing out the first few events that will be predicted using engine position, creates ΔIEAA. ΔPEAA is created by calculating change in engine air amount based on change in engine speed using the method of the present invention. ΔPEAA data has not been shifted and is calculated from a difference equation identified from a different data set. Notice, the close correlation between the prediction made by the present invention and the ideal two-event change in engine air amount. This shows that using a change in engine speed, it is possible to obtain an accurate prediction for engine air amounts that will occur during induction events occurring after the current sample interval. Also, data used to create FIG. 4 and FIG. 5 is different data than the data used to determine model coefficients, FIG. 3A.

Figure 5:
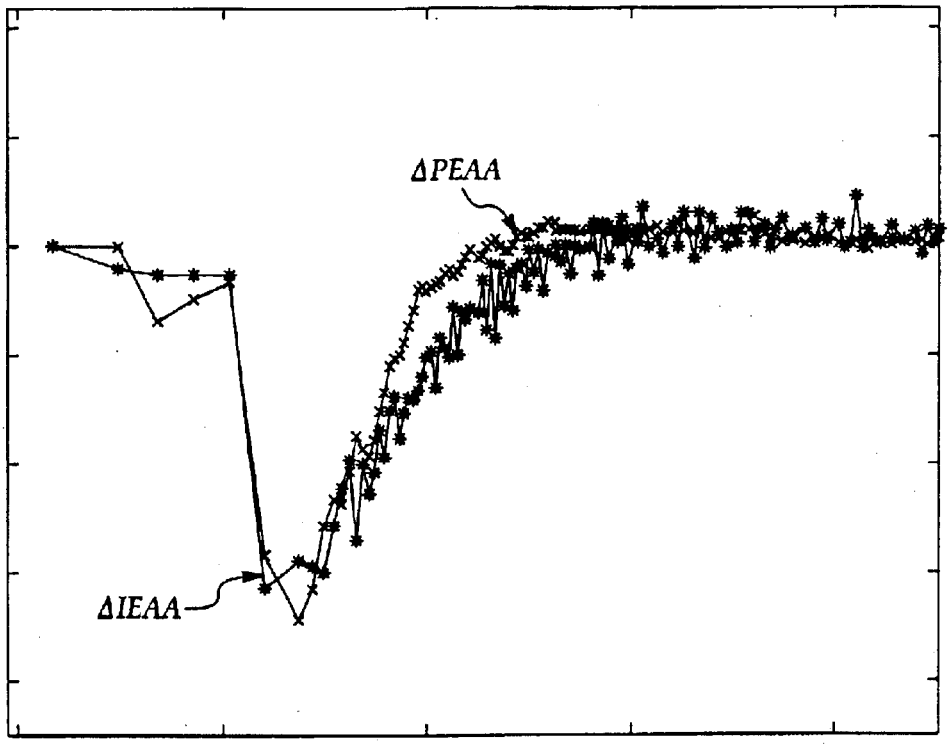
FIG. 5 is a plot showing a comparison between prediction of a change in engine air amount based on engine position and a change in engine speed to ideal prediction of an engine air amount at start.

Referring to FIG. 5, a plot shows change in two-event ideal engine air amount (ΔIEAA), identified by *'s, and predicted two-event engine air amount (ΔPeaa), identified by x's. However FIG. 5 also includes three engine air mount predictions based on engine position. The first two engine position based predictions are made because no change in speed is observed as described above with regard to FIG. 2. The third engine position based prediction is used because the engine speed/engine air amount difference equation needs two engine events to follow the ΔIEAA signal.

Figure 6:
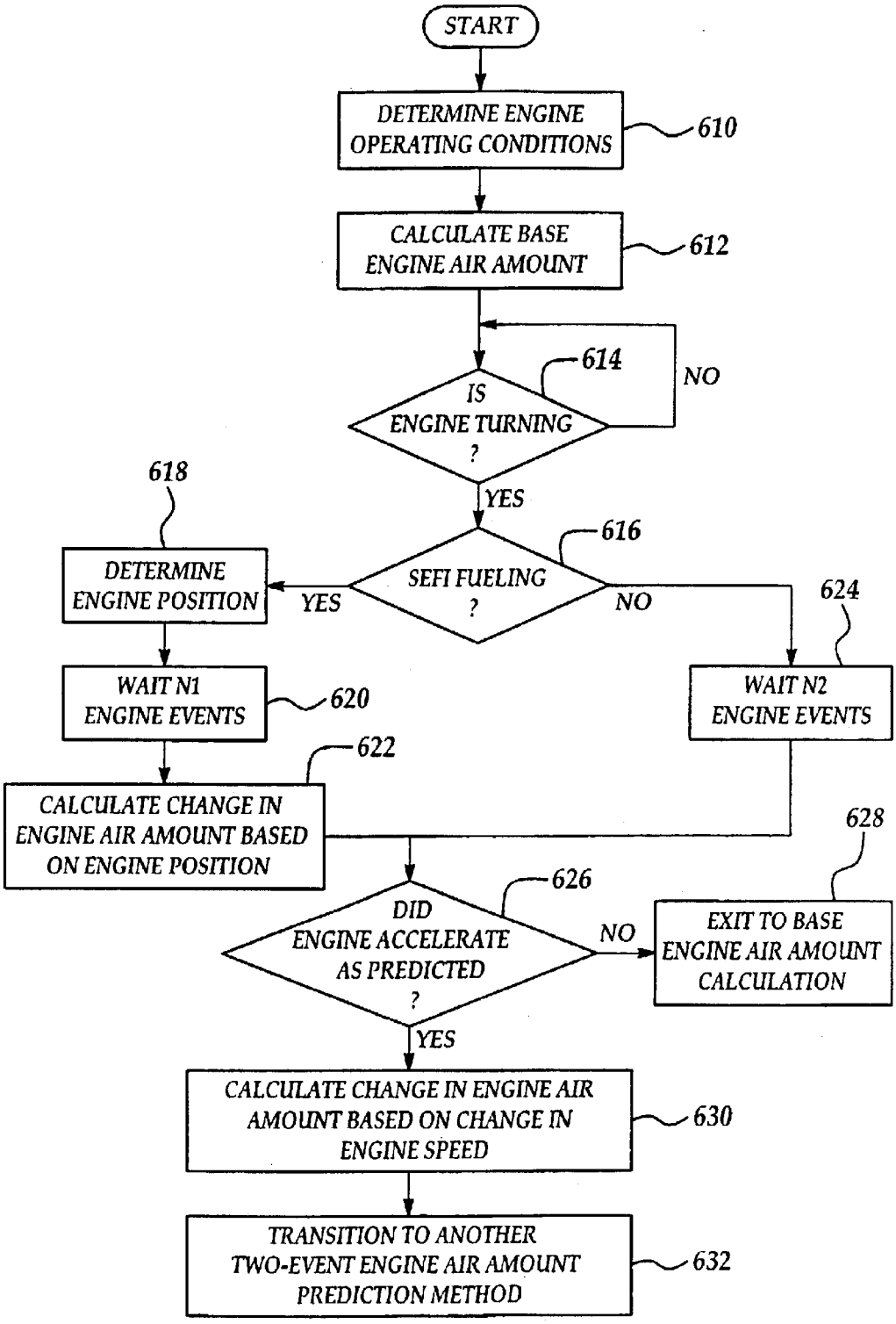
FIG. 6 is a high level flow chart of predicted engine air amount based on method of fuel delivery at start, Big-Bang or sequential.

Referring to FIG. 6, it shows a flowchart of a routine performed by controller 12 that determines how to calculate predicted engine air amount, during a start, based on type of fueling used to start an engine. The routine provides up to three different methods to calculate engine air amount during a start. These methods are performed in sequence based on the current conditions of the engine. In step 610, engine operating conditions are read. Operating conditions are determined by measuring engine coolant temperature (ECT), engine air amount temperature (ACT), barometric pressure (BP), and parameters alike. These parameters are used to compensate engine air amount estimates in blocks 612, 622, and 630. In step 612, a base engine air amount is calculated using the well-known ideal gas law equation PV=mRT, before the engine begins to turn. The ideal gas equation, written for a four-cylinder engine compensated for operating conditions is as follows:

$$Mcyl = \frac{D}{4RT} \cdot \eta(N, load) \cdot P_m \cdot fnBP(BP) \cdot fnTem(ECT, ACT)$$

Where Mcyl is the engine air amount or cylinder air charge, D is the displacement of the engine, R is the gas constant, T is the engine air temperature. The symbol η represents the engine volumetric efficiency, empirically derived, stored in a table with indices of engine speed and load. Manifold pressure, Pm is based on measuring a signal from pressure transducer 122. Barometric pressure compensation is stored as a function, fnBP, and is empirically derived so that it expresses the change in engine air amount as operating barometric pressure deviates from some nominal barometric pressure. Heat transfer between the engine and the engine air amount has an influence on volumetric efficiency and the engine air amount inducted. The table FnTem is an empirically derived table that has x indices of engine coolant temperature (ECT) and y indices of engine air amount temperature (ACT). Based on these engine operating conditions, FnTem provides compensation for heat transfer. Then, this engine air amount is passed to block 812 or block 716, depending on the fueling method selected. In step 614 the controller 12 determines if the engine is turning. If the engine is turning the routine proceeds to step 616, if not, no additional engine air calculations are made until the engine turns. Step 616 selects the engine air amount calculation method based on engine fueling method.

If Sequential Electronic Fuel Injection (SEFI) is selected the routine proceeds to step 618. In step 618 the engine controller 12 determines engine position using signals provided by crankshaft 118 and camshaft 150 sensors. Once engine position is determined, fuel is delivered on a closed valve to the cylinder whose intake stroke is next to occur, reference FIG. 7A SEFI Fueling. SEFI fueling continues for N1 engine events without an update to the change in predicted engine air amount. However, base engine air amount is updated at each engine event, but the change in engine air amount due to a change in engine speed is zero since there is minimal engine acceleration until the first cylinder fueled fires. Step 620 provides engine event delay, when cylinders are not firing no change in predicted engine air amount is needed. Typically, N1 is calibrated to a number of engine events, beginning with the first fueled intake stroke, where N1 is calibrated based on the following equations:

$$X = 720/\#\text{Cylinders}$$

$$N1\ \text{Events} = ((720-360)/X) - 2$$

After N1 events have occurred the routine proceeds to step 622 where the change in engine air amount is retrieved from memory. The predicted change in engine air amount for the next three engine events are stored in a table (Delta_Mcyl). (Note that the number used is determined based on factors such as number of cylinders and number of events predicting ahead. And here, three is selected as an example value for a V6 engine.) The table has x dimension units of engine coolant temperature (ECT) and y dimension units of engine events (k). The stored value is then modified based on the values of parameters measured in step 610. The values stored in memory are empirically derived at nominal engine operating conditions. As conditions deviate from nominal the controller performs the following compensation:

$$\Delta PEAA = Delta_mcyl(ECT,k) \cdot fnBP(BP) \cdot fnTem(ECT,ACT)$$

The base engine air amount, calculated in step 612, is modified by the change in engine air amount to determine the engine air amount for the next three engine events as follows:

Engine Air Amount=Base Engine Air Amount−Change in Predicted Engine Air Amount

Or $$EAA = BEAA - \Delta PEAA$$

These three predicted engine air amounts can be considered to be engine position dependant since they always begin two engine events prior to the power stroke of the first fueled cylinder. Change in predicted engine air amount is calculated on the PIP down edge to ensure recognition of engine acceleration. During a start, engine air amounts are stored to memory, providing the start is representative. In other words, starting engine air amounts are saved if the engine start produces at least one of the following attributes: the expected engine acceleration, the expected air/fuel response, or the expected emissions. The controller 12 can then adapt to engine wear and manufacturing variation by using the stored engine air amounts, and thereby base the engine air amount on past starts. The routine then proceeds to step 626.

If Big-Bang (simultaneously fire all injectors) fueling is identified in step 616 fuel is delivered at the first indicated engine event, reference FIG. 8, and only the base engine air amount is updated based on the ideal gas equation for N2 engine events, where N2 is calculated as follows:

$$N2 = \#cylinders - 2$$

The delay is used with Big-Bang fueling because all cylinders have been fueled and there is no sense updating the engine air amount until the next fuel delivery is scheduled. The routine then proceeds to step 626.

Figure 9:
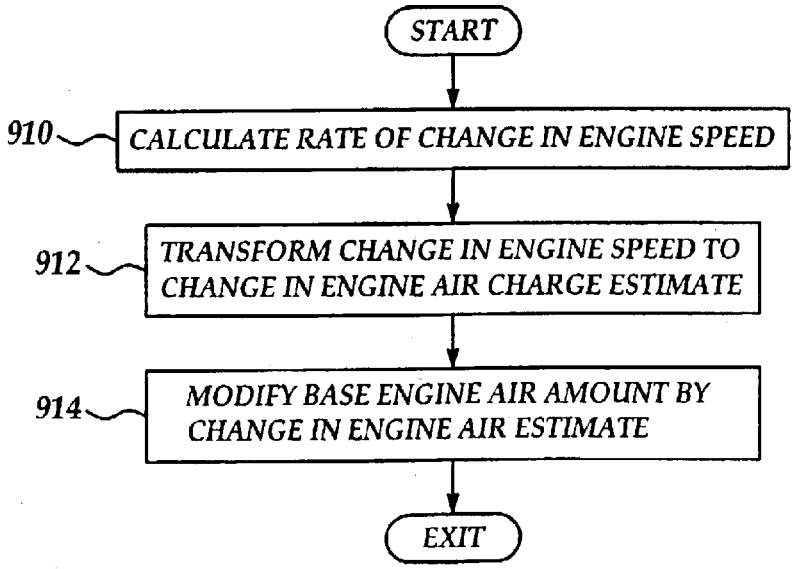
FIG. 9 is a high level flow chart describing engine air amount prediction during a change in engine speed.

In step 626, the engine controller 12 determines if the engine has accelerated as expected. If the expected engine acceleration has not been detected, engine air amount calculations revert to base engine air amount calculations. If the expected engine acceleration has been detected the routine proceeds to step 630. In step 630 the change in engine speed is used to calculate the change in engine air amount, reference FIG. 9. The steps in FIG. 9 are executed until a specified number of engine events have occurred or the change in engine speed falls below a predetermined threshold. Then the routine proceeds to step 632 where the engine air amount calculation is turned over to a different calculation method.

Figure 7A:
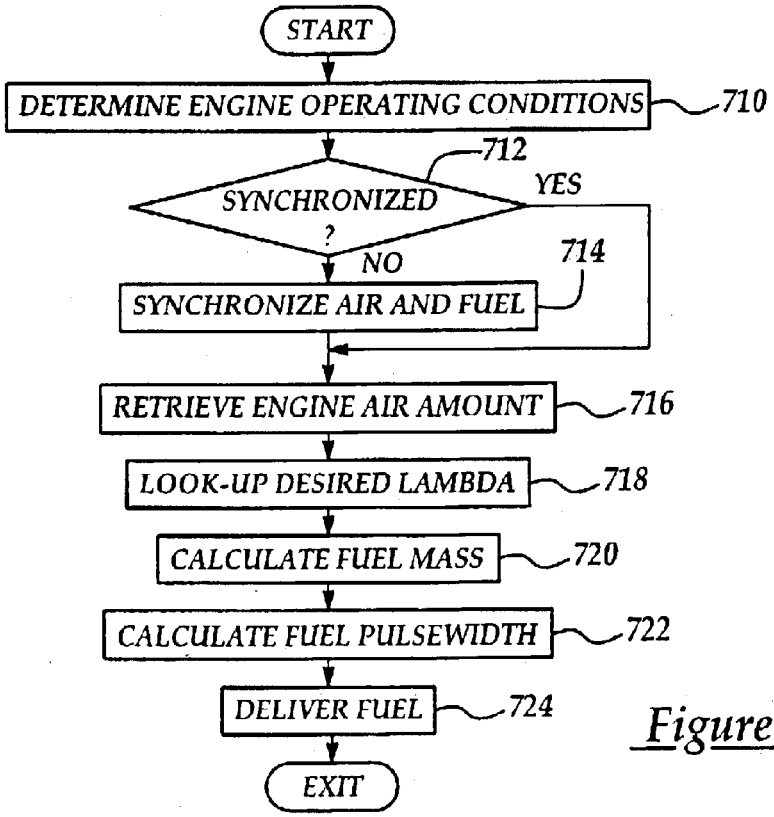
FIG. 7*a* is a high level flow chart describing sequential fuel control based on predicted engine air amount.

Referring to FIG. 7A, a flowchart of a routine performed by controller 12 to control fueling based on a sequential strategy is shown. In step 710, engine operating conditions are read. Operating conditions are determined by measuring engine coolant temperature and parameters alike. These parameters are used to compensate engine fuel amount estimates in block 718. In step 712, the routine decides whether to synchronize air and fuel delivery, step 714, or to proceed and retrieve the engine air amount in step 716. If the air and fuel have not been synchronized, the controller 12 aligns the two-event predicted engine air amount with the next cylinder on intake stroke. In step 716, the two-event engine air amount is retrieved from steps 612, 622, or 630 depending on execution of the routine in FIG. 6. In step 718, the desired Lambda is retrieved from predetermined values stored in a table. The table has x dimension units of engine coolant temperature (ECT) and y dimension units of time since start. Lambda is calculated as follows:

$$\text{Lambda}(\lambda) = \frac{\frac{\text{Air}}{\text{Fuel}}}{\frac{\text{Air}}{\text{Fuel}_{stoichiometry}}}$$

In step 720, fuel mass is calculated based on the engine air amount from step 716, and the Lambda value retrieved in step 718. Fuel mass is calculated as follows:

$$\text{Fuel_Mass} = \frac{\text{Engine_Air_Amount}}{\frac{\text{Air}}{\text{Fuel}_{stoichiometry}}\text{Lambda}}$$

In step 722, injector pulse width is calculated using a function whose input is desired fuel mass and whose output is injector pulse width. In step 724, the injectors are activated for the duration determined in step 722. This process occurs for every injection event, using cylinder specific air amounts, producing cylinder specific fueling.

Referring to FIG. 7B, a table of example predicted engine air amounts derived during a SEFI start. Starting from the left, the first column contains the fueled cylinder induction event number. The second column identifies the method used to calculate change in engine air amount, IGL refers to Ideal Gas Law, PP refers to engine Position based Prediction, and DN refers to Delta engine speed (N). The controller 12 selects the engine air amount calculation based on engine position and acceleration. Column three is the calculated change in predicted engine air amount based on the following identified difference equation:

$$y(k+1) + A_0 y(k) = B_1 x(k+1) + B_0 x(k)$$

or $$y(k) = -A_0 y(k-1) + B_1 x(k) + B_0 x(k-1) \quad (1)$$

Where k indicates the sample number, A's and B's are scalar coefficients, y(k+1) represents predicted engine air amount, y(k) represents the previous engine air amount, x(k+1) represents the current change in engine speed, and where x(k) represents the previous engine speed. Column four contains the change in predicted engine air amount based on the above-mentioned difference equation. This prediction is selected by controller 12 when a predetermined number of engine events have occurred or when a minimum change in engine speed has been detected. Column five contains the prior change in engine air amount multiplied by the factor Ao. Identification of parameters Ao, B1, and Bo is detailed in the description of FIG. 9. Column six contains the prior change in predicted engine air amount. Column seven contains the current change in engine speed multiplied by the factor B1. Column eight contains the prior change in engine speed. Column nine contains the prior change in engine speed multiplied by the factor Bo. Column 10 contains the prior change in engine speed.

Figure 8:
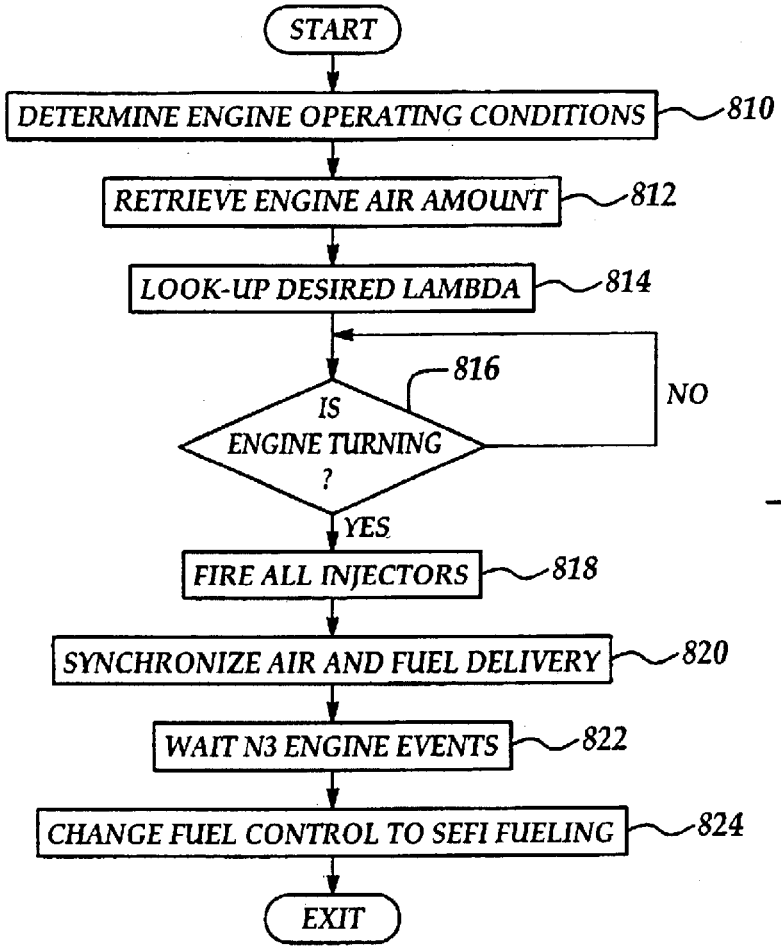
FIG. 8 is a high level flow chart describing Big-Bang fueling and its interaction with predicting engine air amount.

Referring to FIG. 8, a flowchart of a routine performed by controller 12 to provide Big-Bang fueling is shown. In step 810 engine operating conditions are read. Operating conditions are determined by measuring engine coolant temperature and parameters. These parameters are used to compensate engine fuel amount estimates in block 814. In step 812, engine air amount is retrieved from calculations made in step 612. In step 814, the desired Lambda is looked-up using the same method used in step 718. In step 816, the routine determines if the engine is rotating, if so, all injectors are fired simultaneously in step 818, where the first engine event is detected. If the engine is not rotating, fuel is not delivered and the routine waits until rotation is detected. In step 820, the engine controller 12 determines engine position using signals provided by crankshaft 118 and camshaft 150 sensors. Once engine position is determined, predicted engine air amount and fuel delivery are aligned. Big Bang fueling provides fuel for two engine revolutions allowing the controller 12 to wait N3 engine events, step 822, before beginning SEFI fueling, step 824. Note that N3 is the number of cylinders in the engine.

Referring to FIG. 9, a flowchart of a routine performed by controller 12 to calculate a change in engine air amount from a change in engine speed. In block 910, a change in engine speed is calculated. Engine speed changes may be determined in a number of ways using a variety of sensors. One method to calculate a change in engine speed would be to calculate engine speed at two distinct engine events and then subtract the previous measurement from the current measurement. Another method might use the change in engine position divided by the change in time. Sensors used to indicate engine speed would include Hall effect, variable reluctance, tachometers, and optical devices. In step 912, the change in engine speed from step 910 is processed through a transfer function or difference equation of the form:

$$\frac{y(z)}{x(z)} = \frac{B_1 z + B_0}{z + A_0} \quad \text{or}$$

$$y(k+1) = -A_0 y(k) = B_1 x(k+1) + B_0 x(k)$$

The first order equation was selected because it provides a good estimate of ΔIEAA during a change in engine speed without sacrificing computation time incurred by higher order equations. However, various other methods could be used as described below. The coefficients Ao, B1, and Bo are determined from data acquired during a start or some other condition where a large change in engine speed occurs. To determine the coefficients, the change in engine speed and the change in engine air amount are recorded. Then, the change in engine air amount is shifted two engine events in the future. The first three significant values of change in engine air amount are then zeroed out to produce a causal system. In other words, a change in engine speed is being used to predict a change in engine air amount; therefore, a change in engine speed has to occur before a change in engine air amount. Coefficients Ao, B1, and Bo are then calculated using a Least Squares Fit between change in engine speed and change in engine air amount. The following formulae are used to calculate the coefficients:

$$y(k) = -A_0 y(k-1) + B_1 x(k) + B_0 x(k-1) \quad \text{or}$$

$$\begin{bmatrix} y_2 \\ y_3 \\ y_n \end{bmatrix} = \begin{bmatrix} -y_1 & x_2 & x_1 \\ -y_2 & x_3 & x_2 \\ -y_{n-1} & x_n & x_3 \end{bmatrix} \begin{bmatrix} A_0 \\ B_1 \\ B_0 \end{bmatrix} \quad \text{or}$$

$$Y = \Phi\Theta \quad \text{then}$$

$$\hat{\Theta} = (\Phi^T\Phi)^{-1}\Phi^T Y$$

Data acquired from a V6 engine start produced the following coefficients when processed using the before-mentioned Least Squares method:

$$\hat{\Theta} = \begin{bmatrix} A_0 \\ B_1 \\ B_0 \end{bmatrix} = \begin{bmatrix} -0.6807 \\ -7.9759 * 10^{-8} \\ 2.4031 * 10^{-8} \end{bmatrix}$$

Coefficients Ao, B1, and Bo are stored in the memory of controller 12 in table format. Each coefficient is stored in a unique table where engine coolant temperature (ECT) is the x index to the array and barometric pressure (BP) is the y index. In other words, the three coefficients are read from three tables and the table values are empirically derived at different engine coolant temperatures and barometric pressures. Additional tables are added when the method is used during engine running transient conditions. The coefficients may be modified based on engine operating conditions read in step 610. After a start or transient condition, controller 12 can process captured data using the same procedure as described above to modify coefficients Ao, B1, and Bo. The next start or transient condition, with similar engine operating conditions will use the modified coefficients. The coefficients are then used in equation (1) to produce a predicted change in engine air amount based on a change in engine speed, step 914. The change in engine air amount is then used with the base engine air amount to produce an engine air amount based on the following equation:

Engine Air Amount=Base Engine Air Amount−Change in Predicted Engine Air Amount

Or

EAA=BEAA−ΔPEAA

The base engine air amount is calculated in step 612 or may be calculated using another method by another routine in controller 12 depending on how the prediction is used. Additional difference equation identification methods are also envisioned.

Figure 10:
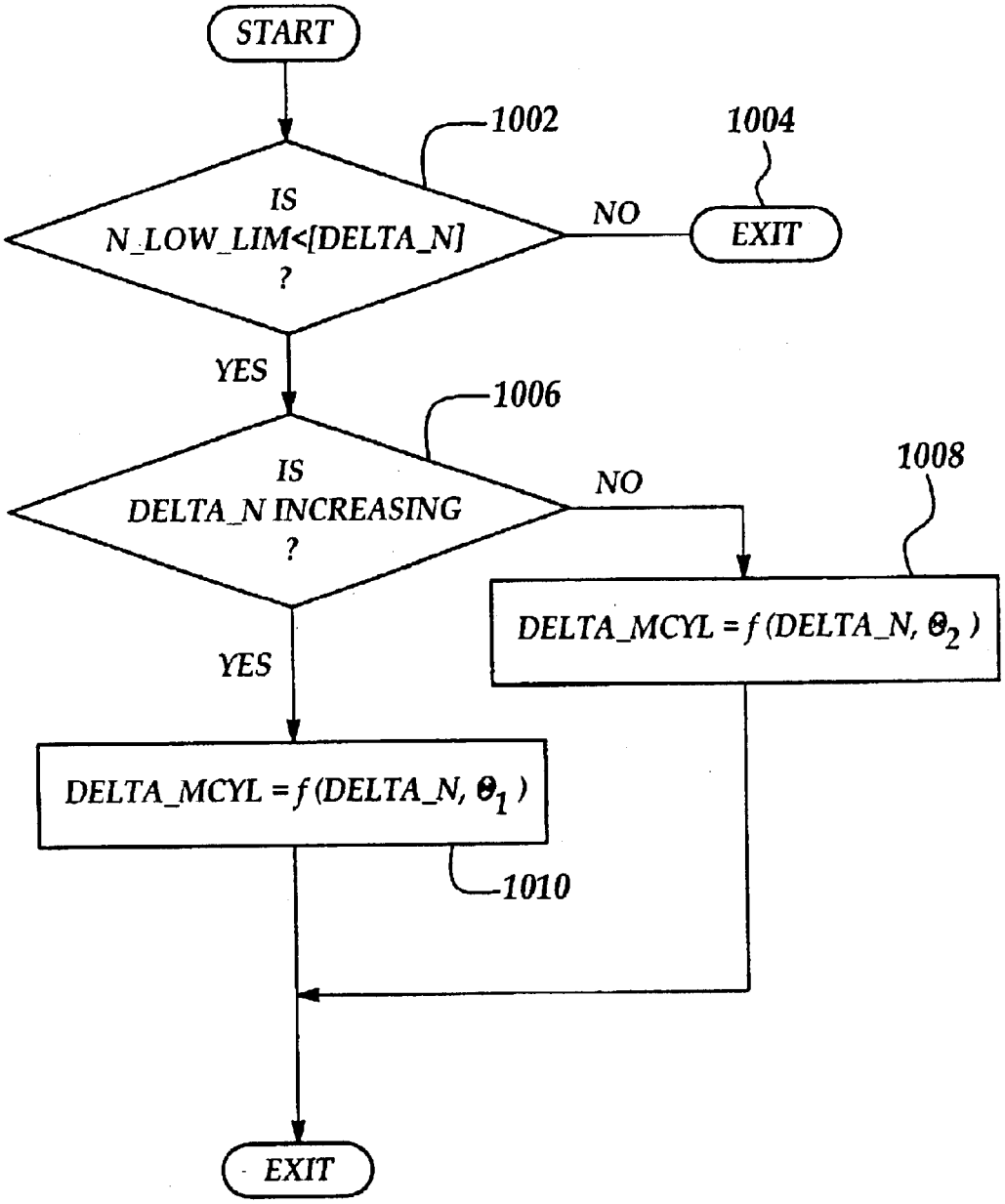
FIG. 10 is a high level flow chart describing when a change in engine speed is used to predict engine air amount during a transient.

Referring to FIG. 10, a flowchart of a routine performed by controller 12 to predict engine air amount during an engine speed transient. The routine begins after a change in engine speed has been observed. Then, a decision is made in step 1002 whether to proceed or exit the routine. If the absolute value of the change in engine speed does not exceed N_LOW_LIM the routine is exited via step 1004. If the change in engine speed exceeds N_LOW_LIM then the routine proceeds to step 1006. Engine acceleration or deceleration is determined in step 1006. If the engine is accelerating, the change in engine speed is processed by difference equation (1), step 1010, whose output is a change in engine air amount, FIG. 9. However, the difference equation coefficients maybe different than those used when the routine is called in step 630. If the engine is decelerating, the change in engine speed is processed by difference equation (1), step 1008, but again may use different coefficients based on deceleration. Engine air amount is then calculated in step 914, based on coefficients from steps 1008 and 1010. The routine then exits back to the calling routine.

As will be appreciated by one of ordinary skill in the art, the routines described in FIGS. 6, 7A, 8, 9 and 10 below may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features and advantages of the invention, but is provided for ease of illustration and description. Although not explicitly illustrated, one of ordinary skill in the art will recognize that one or more of the illustrated steps or functions may be repeatedly performed depending on the particular strategy being used.

This concludes the description of the invention. The reading of it by those skilled in the art would bring to mind many alterations and modifications without departing from the spirit and the scope of the invention. For example, I3, I4, I5, V6, V8, V10, and V12 engines operating in diesel, natural gas, gasoline, or alternative fuel configurations could use the present invention to advantage. Accordingly, it is intended that the scope of the invention be defined by the following claims:

What is claimed is:

1. A fuel injection controlling method for an internal combustion engine, comprising:

counting a number of cylinders receiving at least one fuel injection from a start of an operation of the internal combustion engine; and calculating an estimated engine air quantity based on said counted number of cylinders, and adjusting delivered fuel based on said estimated engine air quantity.

2. The method as set forth in claim 1 wherein said engine air quantity is changed in accordance with an increase in the number of fuel injections.

3. The method as set forth in claim 1 wherein said estimated engine air quantity calculation is further based on ambient air temperature, engine temperature, and barometric pressure.

4. The method as set forth in claim 1 wherein said calculated engine air estimate is further based on data from at least a past start.

5. A fuel injection controlling method for an internal combustion engine, comprising:

counting a number of engine events from a start of an operation of the internal combustion engine; and calculating an estimated engine air quantity based on said counted number of engine events, and adjusting delivered fuel based on said estimated engine air quantity.

6. The method as set forth in claim 5 wherein said engine air quantity is changed in accordance with an increase in the number of engine events.

7. The method as set forth in claim 5 wherein said estimated engine air quantity calculation is further based on ambient air temperature, engine temperature, and barometric pressure.

8. The method as set forth in claim 5 wherein said calculated engine air estimate is further based on data from at least a past start.

9. A computer readable storage medium having stored data representing instructions executable by a computer to control fuel injection for an internal combustion engine, said storage medium comprising:

instructions for counting a number of cylinders receiving at least one fuel injection from a start of an operation of the internal combustion engine; and instructions for calculating an estimated engine air quantity based on said counted number of cylinders, and adjusting delivered fuel based on said estimated engine air quantity.

* * * * *